United States Patent [19]

Järvinen et al.

[11] Patent Number: 4,778,346

[45] Date of Patent: Oct. 18, 1988

[54] METHOD FOR ACTIVATING A GAS PHASE STABILIZER INSTALLED WITHIN A GAS-FILLED PROPORTIONAL COUNTER

[75] Inventors: Marja-Leena Järvinen, Helsinki; Heikki J. Sipilä, Espoo, both of Finland

[73] Assignee: Outokumpu Oy, Helsinki, Finland

[21] Appl. No.: 648,751

[22] Filed: Sep. 7, 1984

[30] Foreign Application Priority Data

Sep. 30, 1983 [FI] Finland ..... 833547

[51] Int. Cl.[4] ..... F04B 37/02

[52] U.S. Cl. ..... 417/53; 417/51

[58] Field of Search ..... 250/374, 432 R; 417/48, 417/51; 313/551, 553; 378/45

[56] References Cited

U.S. PATENT DOCUMENTS

| | | | |
|---|---|---|---|
| 2,986,326 | 5/1961 | Landfors | 417/51 X |
| 4,429,228 | 1/1984 | Anderson | 250/374 |
| 4,464,338 | 8/1984 | Dotson et al. | 250/432 R |

*Primary Examiner*—Edward K. Look

*Attorney, Agent, or Firm*—Dellett, Smith-Hill and Bedell

[57] ABSTRACT

The invention relates to a method for heating a gas phase stabilizer (5) installed within a gas-filled proportional counter (1) in order to activate the stabilizer (5). According to the invention, the heat is conducted into the proportional counter (1) along a thermal inlet (3), which is in thermal exchange contact with the stabilizer (5). The thermal inlet (3) employed in forming the gas filling can advantageously be employed for heating the stabilizer up to the activating temperature.

8 Claims, 1 Drawing Sheet

METHOD FOR ACTIVATING A GAS PHASE STABILIZER INSTALLED WITHIN A GAS-FILLED PROPORTIONAL COUNTER

The present invention relates to a method for activating a gas phase stabilizer, which is installed within a gas-filled proportional counter, without heating the whole counter up to the activating temperature.

BACKGROUND OF THE INVENTION

In the course of time, the stability of a gas-filled proportional counter requires, among other things, that the composition of the gas phase remains unchanged. However, the gas phase composition tends to change for various reasons. For instance, the different materials which the proportional counter is made of gradually emit gases absorbed in their surfaces; gases trapped in the pores of the materials also continuously flow into the gas filling. Moreover, small leakages from the window and/or the jointings of the proportional counter cause changes in the gas phase composition. Thus the properties of the whole proportional counter easily change if any impurities enter the gas phase.

The conventional methods for manufacturing proportional counters aim at achieving a steady stability for the gas phase by means of pumping the counter, i.e. the detector, for a long time before filling, and by heating it simultaneously. This method is not, however, completely secure in eliminating all possible sources wherefrom the gas filling can in the course of time be contaminated.

In the prior art, gas phase stabilizers operated in room temperature have been developed to eliminate the gases emitted in various vacuum tubes. Noble gases are chemically completely inert, and therefore the same stabilizers, the getters, can be employed for maintaining the purity of the noble gas filling.

It is, however, necessary to activate the gas stabilizers, i.e. the getters, before they can bind impurities. The activating is normally carried out by heating the stabilizer in a vacuum up to the temperature of 500°–800° C., while the activating time depends on the required temperature.

The commonest methods for activating the gas phase stabilizer of a proportional counter are resistance heating and high-frequency heating. Resistance heating requires that an extra electric inlet is installed within the proportional counter, which adds the complexity of the proportional counter structure, and thus increases its manufacturing costs. High-frequency heating is out of question if the gas phase stabilizer, the getter, must be located essentially within a counter which is altogether made of metal. Moreover, the heating of the whole counter in order to activate the stabilizer is impossible, because the jointings used in manufacturing the counter do not, as a whole, endure the high temperature required in the heating.

The purpose of the present invention is to eliminate the drawbacks of the prior art and to achieve a method, both better and more secure in operation than the prior art methods, for heating the gas phase stabilizer so that the stabilizer can be activated and thereafter employed for eliminating the impurities emitted into the gas filling.

SUMMARY OF THE INVENTION

In an embodiment of the invention, the heating of the stabilizer, i.e. the getter, up to the activating temperature is carried out by conducting the heat along a thermal inlet so that it is not necessary to heat the whole counter up to the activating temperature. In order to achieve this, that part of the proportional counter wall which surrounds the thermal inlet is made of a thermonegative material, i.e. a material that is a poor thermal conductor, such as stainless steel. Within this part of the wall is fitted an inlet made of a thermopositive material (a material that is a good thermal conductor), such as copper, the inlet being essentially a tube which can also be employed for emptying the counter before filling it with the filling gas. The inlet can also have a form other than tubular; it can for example be bar-like. Furthermore, the conducting body fitted through the wall is jointed to the counter with a material which has a high melting temperature. Thus, if the thermopositive material is heated up, the heat is conducted along the conducting body into the counter. Heat leakage into the detector body takes place comparatively slowly, because the part of the wall surrounding the inlet is made of a thermonegative material. That part of the conducting body which remains within the counter can be provided with a stabilizer support made advantageously of the same material as the inlet , in which case the stabilizer will be in optimal direct thermal exchange contact with it. It is also possible to arrange the stabilizer apart from the inlet, so that they will be in indirect thermal exchange contact.

The gas phase stabilizer, the getter, of the proportional counter is advantageously made of a porous material with a large specific surface, such as sintered zirconium powder.

BRIEF DESCRIPTION OF THE DRAWINGS

In the following the invention is described with reference to the appended drawings, where.

DETAILED DESCRIPTION

Figure 1:
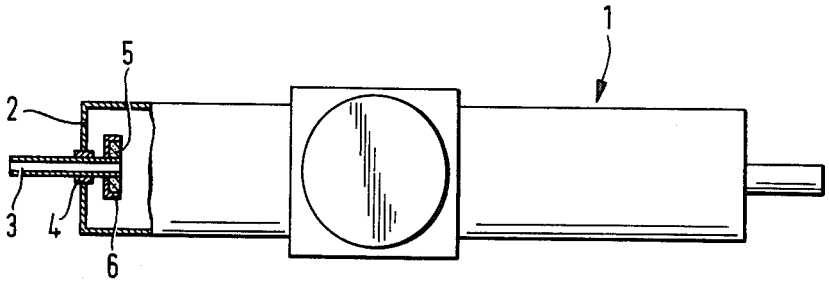
FIG. 1 is a schematical illustration of a preferred embodiment of the invention in partial cross-section and seen from the side.

In FIG. 1, the thermal inlet 3 is fitted in the other end of the proportional counter 1 in order to realize the method of the invention. The inlet 3, which is made of a material essentially more thermopositive than that of the end 2, is jointed to the end 2 with a material 4 which has a high melting temperature. In order to support the gas filling stabilizer 5, the inlet 3 is provided with the support 6, which is advantageously made of the same material as the inlet 3.

In order to realize the stabilizer activating method according to the invention, the inlet 3 is connected to an energy source in order to heat the inlet 3. Now heat is conducted, along the inlet 3, to within the proportional counter 1, i.e. to the stabilizer support 6, in which case the stabilizer 5 is heated and thus activated. Because the inlet 3 is jointed to the end 2 by means of the material 4 with a high melting temperature, and because the end 2 is made of a material which is essentially more thermonegative than the inlet 3, the stabilizer 5 can be activated with low energy losses as regards other members of the proportional counter 1.

Figure 2:
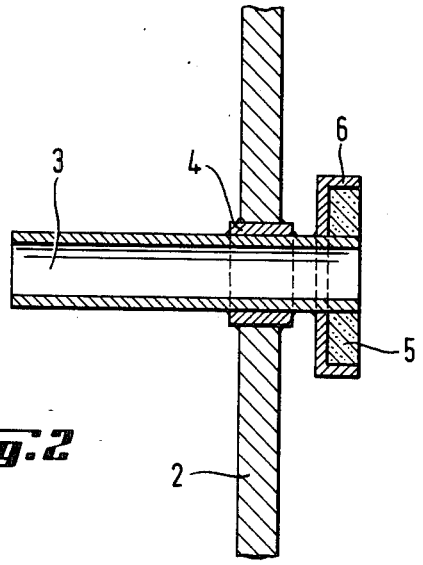
FIG. 2 is an illustration of the end piece of the preferred embodiment of FIG. 1, as well as of the inlet adjusted therein, here enlarged and in cross-section.

FIGS. 1 and 2 suggest a tubular form for the thermal inlet 3, but the invention can also be applied should the inlet 3 have some other form. When employing an inlet 3 other than of tubular form, the proportional counter 1 must be emptied and thereafter filled with the filling gas through some other inlet fitted in the proportional counter 1. Furthermore, in FIGS. 1 and 2 the stabilizer 5 is connected to the inlet 3, but the stabilizer 5 can also be placed apart from the thermal inlet 3, as long as it is placed essentially near to the inlet 3, without essentially violating the idea underlying the invention. In that case the heat from the inlet 3 is conducted onto the stabilizer 5 by means of radiation.

It is naturally clear that the thermal inlet 3 can also be placed in the wall of the proportional counter 1 on some other spot than the end 2 illustrated in FIG. 1.

We claim:

1. A method for activating a gas phase stabilizer installed within a proportional counter without heating the entire proportional counter up to the activating temperature, comprising providing the counter with a thermal inlet in good heat exchange relationship with the stabilizer, and applying thermal energy to the thermal inlet at a location outside the counter whereby the stabilizer is heated by heat conducted into the counter by way of the thermal inlet.

2. A method according to claim 1, wherein said thermal inlet comprises a rod-like element of good thermal conductivity extending from the exterior of the counter into the interior thereof.

3. A method according to claim 2, wherein said rod-like element is a tubular element.

4. A method according to claim 1, wherein said thermal inlet and the stabilizer are in direct heat exchange contact.

5. A method for activating a gas phase stabilizer installed within a proportional counter including a rod-like element of good thermal conductivity extending from the exterior of the counter into the interior thereof and being in good heat exchange relationship with the stabilizer, said method comprising applying thermal energy to the rod-like element at a location outside the counter whereby heat is conducted into the counter by way of the rod-like element for heating the stabilizer without heating the entire counter.

6. A method according to claim 5, wherein said rod-like element is a tubular element.

7. A method according to claim 5, wherein the rod-like element and the stabilizer are in direct heat exchange contact.

8. An improved method of manufacturing a proportional counter, comprising forming wall means defining an interior chamber, and fitting a tubular element of good thermal conductivity and having first and second ends in the wall means so as to provide communication between the exterior of the chamber and the interior of the chamber, the first end of the tubular element being within the chamber and in good heat exchange relationship with a gas phase stabilizer located within the chamber wherein the improvement comprises introducing a selected gas into the chamber by way of the tubular element and subsequently applying thermal energy to the second end of the tubular element whereby the stabilizer is heated by heat conducted along the tubular element.

* * * * *